US005085012A

United States Patent [19]

Hutchins

[11] Patent Number: 5,085,012

[45] Date of Patent: Feb. 4, 1992

[54] RECIPROCATING ABRADING OR POLISHING TOOL WITH IMPROVED SUCTION SYSTEM

[75] Inventor: Donald H. Hutchins, Sierra Madre, Calif.

[73] Assignee: Hutchins Manufacturing Company, Los Angeles, Calif.

[21] Appl. No.: 585,908

[22] Filed: Sep. 21, 1990

Related U.S. Application Data

[62] Division of Ser. No. 538,245, Jun. 14, 1990, Pat. No. 5,001,869.

[51] Int. Cl.[5] ..... B24B 55/06

[52] U.S. Cl. ..... 51/273; 51/170 TL

[58] Field of Search ..... 51/170 TL, 170 MT, 273, 51/170 R, 170 PT, 170 T, 170 EB

[56] References Cited

U.S. PATENT DOCUMENTS

| | | | |
|---|---|---|---|
| 2,956,379 | 10/1960 | Statler | 51/273 |
| 3,785,092 | 1/1974 | Hutchins | 51/170 MT |
| 3,793,781 | 2/1974 | Hutchins | 51/170 TL |
| 3,815,292 | 6/1974 | Hutchins | 51/170 MT |
| 3,824,745 | 7/1974 | Hutchins | 51/273 X |
| 3,835,592 | 9/1974 | Sumida | 51/170 TL |
| 3,932,963 | 1/1976 | Hutchins | 51/170 TL |
| 4,052,824 | 10/1977 | Hutchins | 51/170 MT |
| 4,145,847 | 3/1979 | Hutchins | 51/170 TL |
| 4,302,910 | 12/1981 | Tschacher | 51/170 MT |
| 4,355,487 | 10/1982 | Maier et al. | 51/273 X |
| 4,549,371 | 10/1985 | Hakoda | 51/170 MT |
| 4,671,020 | 6/1987 | Hutchins | 51/170 MT |
| 4,839,995 | 6/1989 | Hutchins | 51/170 MT |

*Primary Examiner*—M. Rachuba
*Assistant Examiner*—John A. Marlott
*Attorney, Agent, or Firm*—William P. Green

[57] ABSTRACT

A portable abrading or polishing tool including a body containing a cylinder chamber, a piston reciprocable within the cylinder chamber, a shoe which is reciprocated relative to the body by the piston but oppositely from the piston, and at least one counterweight which is located laterally adjacent the piston and is reciprocated oppositely from the piston to reduce vibration of the tool. There may be two at opposite sides of the piston; and a third counter weight such counterweight which is located near the shoe and reciprocated oppositely from the shoe. The tool may include bearing elements interposed between the body of the tool and the shoe and containing openings communicating with passages formed in a pad carried by the shoe to conduct a flow of air or another fluid to or from those passages.

7 Claims, 5 Drawing Sheets

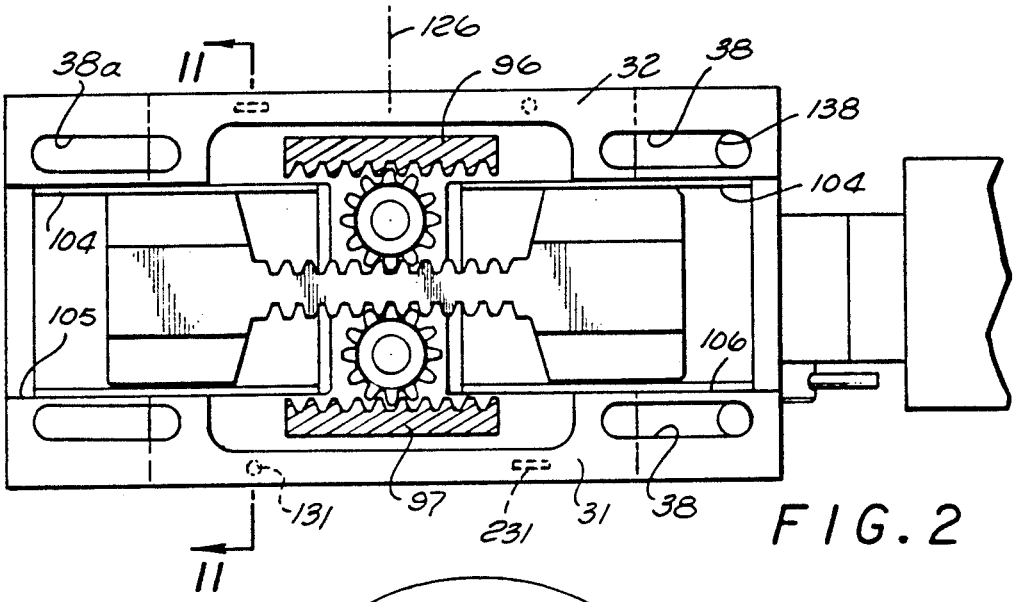
FIG. 2
FIG. 3
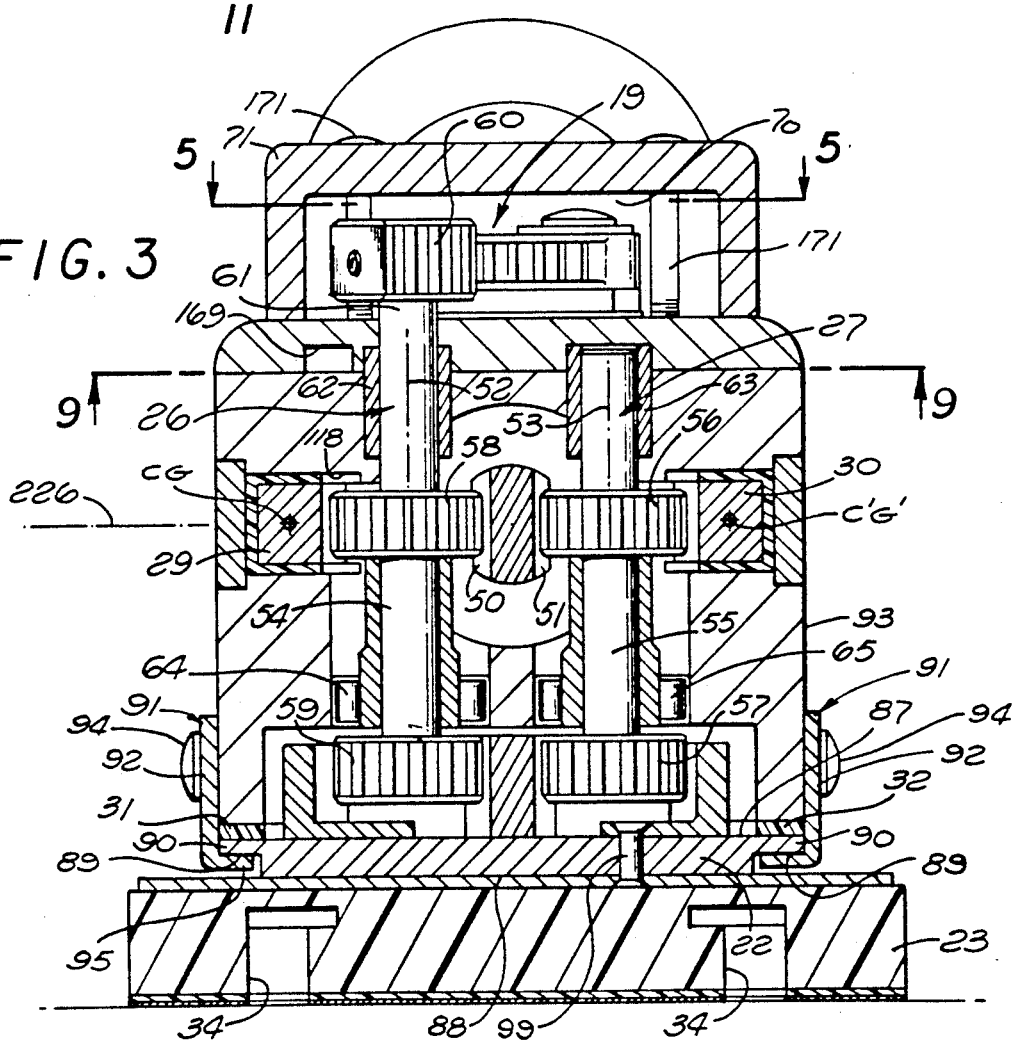

RECIPROCATING ABRADING OR POLISHING TOOL WITH IMPROVED SUCTION SYSTEM

This is a divisional of copending application Ser. No. 07/538,245 filed on Jun. 14, 1990, now U.S. Pat. No. 5,001,869, issued Mar. 26, 1991.

This invention relates to improved portable power sanders or other abrading or polishing tools.

BACKGROUND OF THE INVENTION

U.S. Pat. No. 3,932,963 issued Jan. 20, 1976 discloses an abrading tool including a body containing a cylinder chamber within which a piston is reciprocable by fluid pressure, and including a shoe adapted to carry a sheet of sandpaper for sanding a work surface. The shoe is reciprocated oppositely from the piston by gear units engaging rack teeth on the piston and the shoe. A flow of air carrying particles abraded from the work surface is drawn by suction through passages in a pad which is carried by the shoe and to which the sandpaper is attached. U.S. Pat. No .4,145,847 issued Mar. 27, 1979 shows a similar tool having a counterweight which is located near the shoe and is reciprocated oppositely from the shoe and with the piston to reduce the tendency for vibration of the tool body in use. Other similar tools are shown in U.S. Pat. No. 4,052,824 issued Oct. 11, 1977 and U.S. Pat. No. 4,228,620 issued Oct. 21, 1980.

SUMMARY OF THE INVENTION

A major purpose of the present invention is to provide an improved counterweighting arrangement for a power tool of the above discussed general type, to increase the effectiveness with which the reciprocating forces are counterbalanced, and thereby further reduce and preferably essentially eliminate the transmission of vibrational forces to the tool body and through that body to a user's hands. This result is achieved by inclusion in the tool of at least one additional counterweight located at a side of the reciprocating piston structure and which is reciprocated by the piston but oppositely from the piston. Preferably two such additional counterweights are provided at opposite sides of the piston to counterbalance movement of the piston in optimum fashion, while another counterweight similar to that shown in U.S. Pat. No. 4,145,847 is provided near the shoe to counterbalance its reciprocating movements. The counterweights associated with the piston may be located within recesses formed in the body of the tool at opposite sides of the piston, and may be driven by gear units interposed between the piston structure and the counterweights.

An additional feature of the invention relates to improvements in the manner in which a flow of air and entrained particles abraded from a work surface are withdrawn from the reciprocating shoe of the device. More particularly, the invention contemplates delivery of the air and abraded particles through openings formed in bearing elements which are interposed between the body of the tool and the reciprocating shoe.

BRIEF DESCRIPTION OF THE DRAWINGS

The above and other features and objects of the invetnion will be better understood from the following detailed description of the typical embodiment illustrated in the accompanying drawings, in which:

FIG. 2 is a horizontal section taken on line 2—2 of FIG. 1;

FIG. 3 is an enlarged vertical section taken on line 3—3 of FIG. 1;

DETAILED DESCRIPTION OF THE PREFERRED EMBODIMENT

Figure 1:
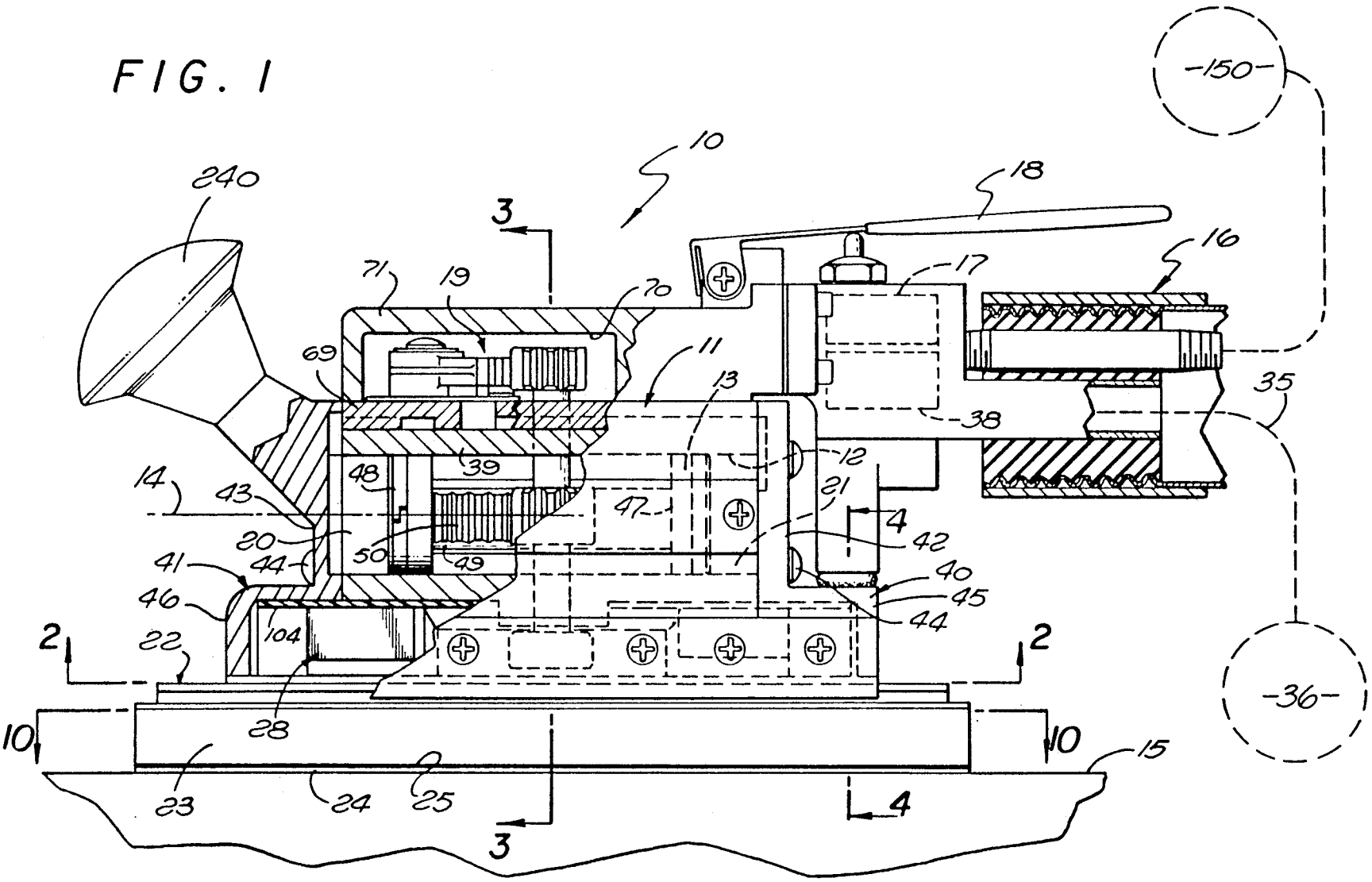
FIG. 1 is a side elevational view, partially broken away, of a portable powered sander embodying the invention.

Referring first to FIG. 1, the sanding tool 10 there illustrated includes a main body 11 containing a cylindrical bore 12 within which a piston 13 is reciprocable along an axis 14. In the FIG. 1 position of the tool, the bore 12, piston 13, and axis of reciprocation 14 extend horizontally, and it is assumed that the tool is being utilized to sand an upwardly facing horizontal work surface 15 beneath the tool. Compressed air or other actuating fluid is delivered to the opposite ends of cylinder bore 12 from a source 150 of such pressure fluid, and through a tubular handle 16 rigidly secured to or forming a portion of body 11. A valve 17 controls the delivery of this compressed air to the reciprocating piston by actuation of a trigger element 18. An automatic valve assembly 19 admits the compressed air alternately to the cylinder chambers 20 and 21 at opposite ends of piston 13, with timing predetermined to cause powered reciprocation of the piston. A shoe 22 extends along the underside of body 11, and carries a pad 23 which is reciprocable with the shoe in a straight line motion parallel to axis 14 to cause a sheet of sandpaper 24 at the underside of the pad to abrade work surface 15. The sandpaper sheet may be retained on the shoe by an appropriate adhesive represented at 25, or by conventional clips or other retaining elements.

Figure 10:
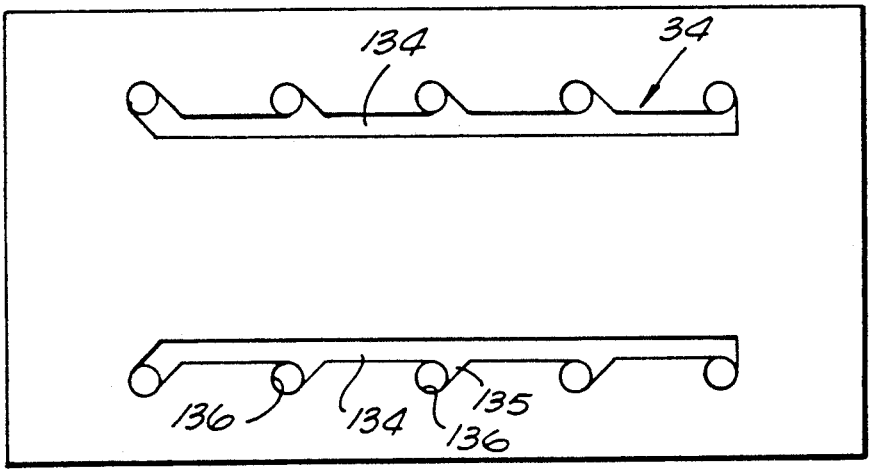
FIG. 10 is a reduced horizontal section taken on line 10—10 of FIG. 1.
Figure 11:
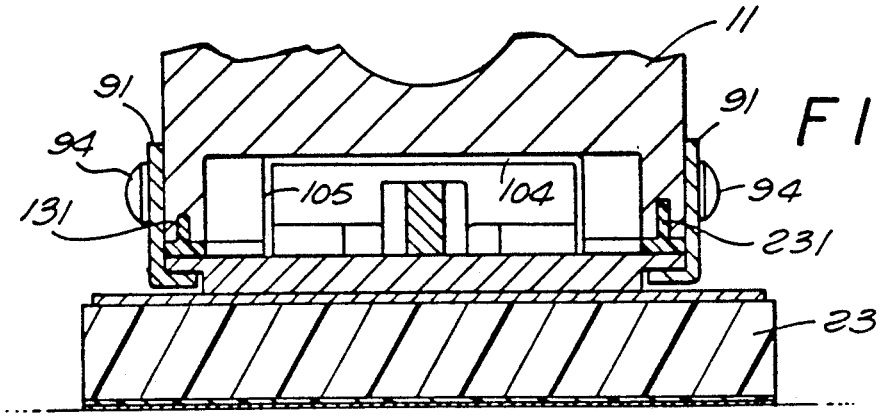
FIG. 11 is an enlarged fragmentary vertical section taken on line 11—11 of FIG. 2.

Shoe 22 is reciprocated by piston 13 but oppositely from the piston by two gear units 26 and 27. These gear units also drive a first lower counterweight 28 located vertically between piston 13 and shoe 22 and closely adjacent the shoe, and two upper counterweights 29 and 30 spaced above counterweight 28 and the shoe and located at essentially the same level as and at opposite sides of piston 13. Downward forces are transmitted from body 11 of the tool to shoe 22, pad 23, sandpaper sheet 24 and the work through two elongated horizontal bearing elements 31 and 32 interposed vertically between body 11 and the shoe. A flow of air carrying particles abraded from work surface 15 is drawn by suction through a series of passages 34 formed in pad 23 (FIG. 10), and through a conduit 35 to a dust collection bag 36. This flow of air and abraded particles is preferably conducted from the shoe passages 34 through elongated openings 38 formed in the two bearing elements 31 and 32. The suction for producing the flow of air and particles from the work surface to the collection bag may be produced by an aspirator which is represented diagrammatically at 38 and is energized by air discharged from the cylinder chambers at opposite ends of piston 13.

Body 11 is preferably formed sectionally of a number of parts, including a main central section 39 and two opposite end members 40 and 41 having vertical portions 42 and 43 secured to the opposite ends of central section 39 by screws 44 extending through openings in members 40 and 41 and connecting threadedly into central section 39. The end members 40 and 41 extend across and close the opposite ends of cylinder bore 12. The lower portions 45 and 46 of end members 40 and 41 project horizontally in opposite directions at the upper side of shoe plate 22. A forward handle 240 is carried by member 41.

Piston 13 is preferably double acting, having enlarged piston heads 47 and 48 at its opposite ends connected together by a reduced diameter portion 49 having two sets of rack teeth 50 and 51 extending along its opposite sides and facing in opposite horizontal directions transversely of axis 14 of the piston. These rack teeth 50 and 51 engage the two gear units 26 and 27 in a relation turning them about two parallel vertical axes 52 and 53 (FIG. 3) lying in a common vertical plane disposed transversely of axis 14. The gear unit 27 has two vertically spaced gears 56 and 57 rigidly carried by a cylindrical shaft 55. The upper of these gears, number 56, meshes with and is oscillated rotatively about axis 53 by rack teeth 51 on piston 13. A shaft 54 of the other gear unit 26 also rigidly carries two vertically spaced gears 58 and 59 corresponding essentially to gears 56 and 57 of the first unit 27. Gear 58 of unit 26 engages the second set of rack teeth 50 on piston 13 to be oscillated thereby rotatably but oppositely from gear 56. Unit 26 also includes a third gear 60 rigidly carried by an upward extension 61 of shaft 54 for actuating valve assembly 19. In order to mount the shafts 54 and 55 of gear units 26 and 27 for rotation about their axes 52 and 53, upper portions of the shafts are journalled within a pair of sleeve bushings 62 and 63, and lower portions of the shafts are journalled within roller bearings or other suitable bearing assemblies 64 and 65, desirably constructed to function as thrust type bearings to support shafts 54 and 55 in the FIG. 3 positions.

Figure 5:
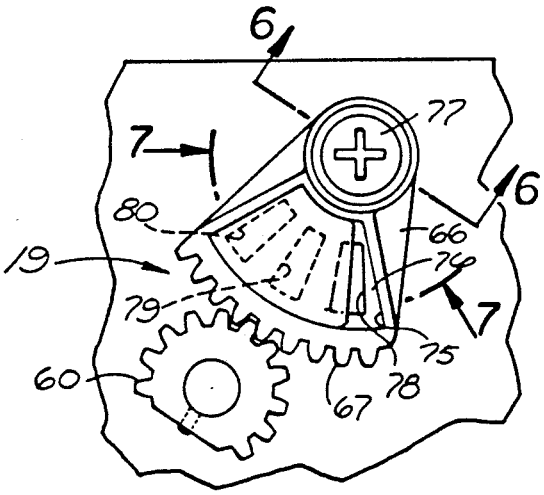
FIG. 5 is an enlarged detail representation of the automatic valving mechanism, taken on line 5—5 of FIG. 3.
Figure 6:
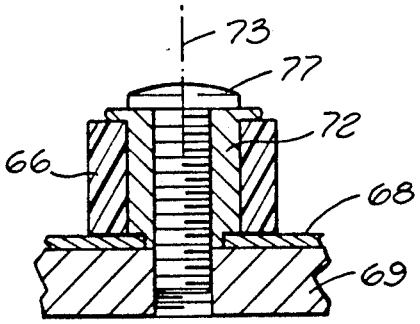
FIG. 6 and 7 are enlarged fragmentary vertical sections taken on lines 6—6 and 7—7 respectively of FIG. 5.
Figure 7:
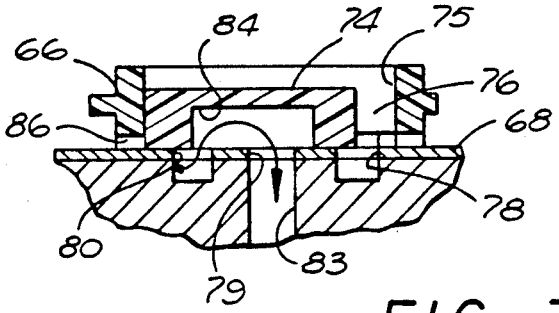

Valve mechanism 19 is operated by the piston through gear unit 26, and functions to admit compressed air alternately to the two cylinder chambers 20 and 21 at opposite ends of the piston, to thereby reciprocate the piston along axis 14. The preferred valving mechanism illustrated in FIGS. 5 through 7 is of the general type shown in the above discussed prior patents, and includes a sector element 66 (FIG. 5) having an arcuate series of teeth 67 meshing with the upper gear 60 of gear unit 26. Sector element 66 is received adjacent an upper horizontal generally triangular plate 68 (FIG. 8) secured rigidly by an adhesive to the horizontal upper surface of a top wall 69 of body 11. This top wall or plate 69 is attached to the upper side of section 39 of the body by an adhesive, and has grooves or passages 81 and 82 formed at its underside for conducting air between opposite ends of the piston and valve mechanism 19. Referring to FIG. 1, the air from source 150 flows past manually actuated valve 17 into an inlet chamber 70 formed above part 69 and within a hollow member 71 secured by a number of screws 171 to members 39 and 69.

The valve mechanism 19 is functionally very similar to the valve discussed in detail in U.S. Pat. No. 3,932,963. Sector element 66 of this valve mechanism is mounted by a vertical cylindrical sleeve 72 at the upper side of plate 68 for rotary oscillating movement about a vertical axis 73, to actuate a valve element 74 which is shaped essentially as a sector of a circle and is received within a similarly shaped recess 75 formed in sector element 66. The sector-shaped recess 75 has somewhat greater arcuate extent than does sector shaped valve element 74, to allow a gap 76 between part 74 and the side or sides of the recess or opening 75, so that there is some lost motion between the oscillation about axis 73 of element 66 and valve element 74. The bushing sleeve 72 may be rigidly secured to plate 69 by a screw 77.

Plate 68 contains three radially elongated sector shaped apertures 78, 79 and 80 (FIGS. 3, 5 and 7). Of these, the two end apertures 78 and 80 communicate with passages 81 and 82 respectively at the underside of plate 69 leading to chambers 20 and 21 at the opposite ends of the piston. The middle aperture 79 communicates with an exhaust passage 83 (FIG. 7) through which air may be discharged from the valve assembly to atmosphere. As seen in FIG. 7, the valving element 74 contains a sector shaped recess 84 at its underside of a width to place exhaust passage 83 alternately in communication with the two passages 81 and 82 respectively. In the particular position illustrated in FIG. 7, the passage 82 is exhausting to atmosphere through aperture 80 and passage 83, while the passage 81 is receiving inlet air from chamber 70 through gap 76. When the sector element 66 oscillates in a counterclockwise direction from the position of FIG. 5, element 74 is moved with element 66 to a position in which apertures 78 and 79 are placed in communication with one another through chamber 84 at the underside of element 74, to discharge air from the opposite end of the piston through passage 83. At the same time, air is admitted to the other end of the piston through aperture 80 which is then in communication with the inlet air chamber 70 through a gap 86 formed at the underside of the sector element 66. As will be apparent without further discussion, the oscillating valve element 74 thus first admits air to chamber 20 at the left side of piston 13 in FIG. 1 while exhausting air from chamber 21 at the right end of the piston, and then at the end of a rightward stroke of the piston reverses the connections to admit air to chamber 21 and exhaust it from chamber 20 and cause leftward movement of the piston, thus resulting in automatic reciprocation of the piston and corresponding rotary oscillation of the gear units 26 and 27. The gap circularly between elements 66 and 84 as represented at 76 in FIGS. 5 and 7 provides a lost motion relationship between elements 66 and 84 allowing a predetermined and limited initial movement of element 66 in each direction before element 84 is moved.

The shoe plate 22 is a rigid preferably metal part having the cross section illustrated in FIG. 3, to form an upper horizontal planar surface 87 and a parallel planar horizontal undersurface 88. Along its opposite sides, the shoe contains two recesses 89 at its underside forming a pair of laterally projecting reduced thickness flanges 90 extending parallel to axis 14. The undersurfaces of these flanges are horizontal and co-planar, and the discussed cross section of shoe 22 as shown in FIG. 3 is uniform along the entire length of the shoe plate.

The shoe plate 22 is slidably guided and retained against downward movement relative to body 11 by a pair of track or rail members 91, having vertical portions 92 received against the vertical side surfaces 93 of the various body sections 39, 40 and 41, and secured thereto by screws 94. At their lower edges the two track elements 91 have horizontally inturned flanges 95, whose co-planar upper horizontal surfaces slidably engage the horizontal undersurfaces of flanges 90 of the shoe plate, to guide it for straight line reciprocating movement parallel to axis 14. As will be apparent from FIG. 3, the outer edges of flanges 90 engage and are slidably retained by the vertical portions 92 of guide tracks 91 to retain shoe plate 22 against lateral movement. The cross sections of tracks 91 as seen in FIG. 3 are uniform along the entire front to rear extent of the body.

At its upper side, shoe plate 22 has two rack members 96 and 97, having horizontal mounting portions 98 secured by rivets or screws 99, or otherwise, to shoe 22. Racks 96 and 97 have upwardly projecting portions 100 with horizontally inwardly facing rack teeth 101 engageable with the two lower gears 59 and 57 of gear units 26 and 27 respectively. That is, the lower gear 59 of unit 26 engages the teeth of rack element 96, while the lower gear 57 of unit 27 engages the teeth of rack unit 97, to reciprocate shoe 22 in a front to rear direction in response to rotary oscillation of shafts 54 and 55 by piston 13. The shoe, however, reciprocates oppositely from the piston.

Figure 4:
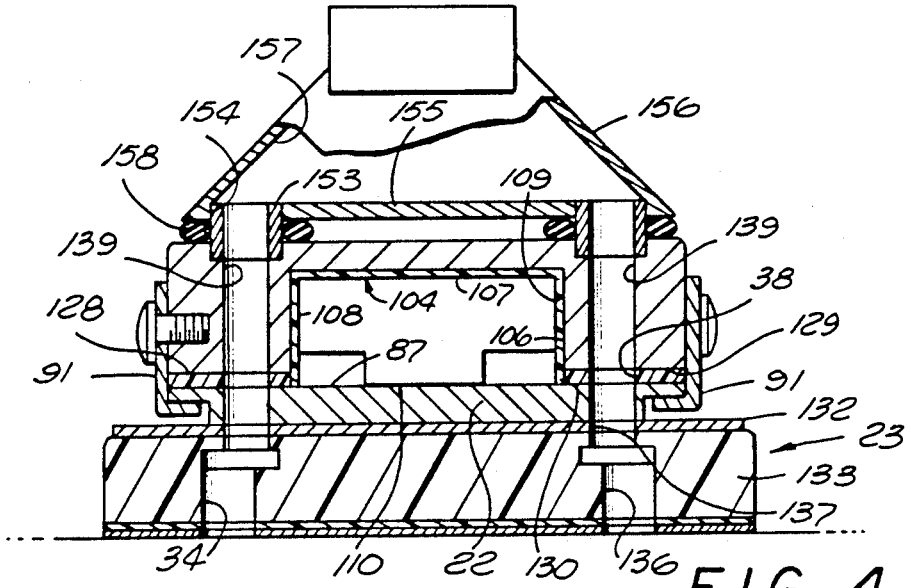
FIG. 4 is a vertical section taken on line 4—4 of FIG. 1.
Figure 8:
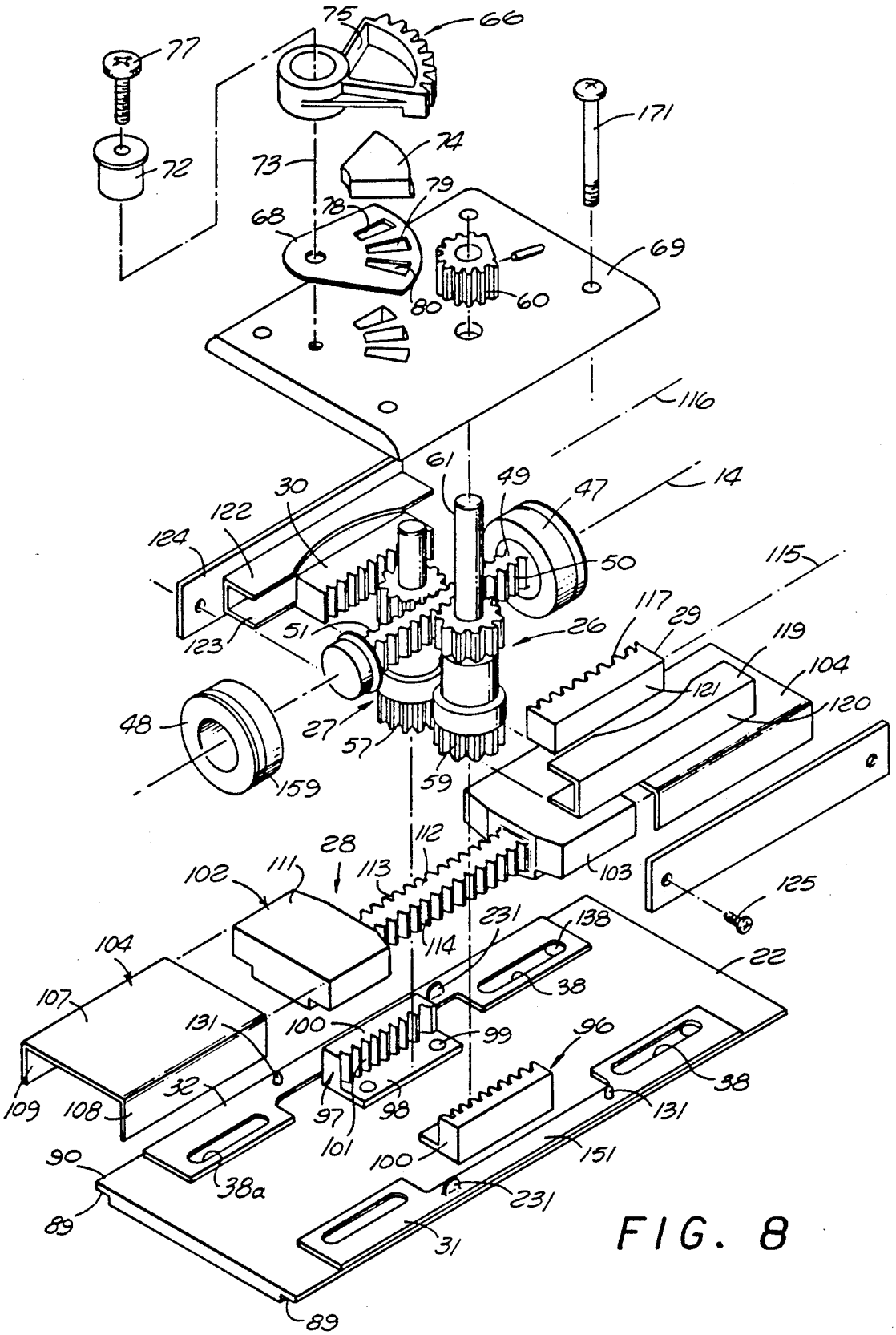
FIG. 8 is an exploded perspective view showing certain of the working parts of the tool.

Counterweight 28 has front and rear relatively wide portions 102 and 103 slidably received and guided within two inverted U-shaped bushing or guide elements 104 contained within front and rear recesses 105 and 106 formed in sections 39, 40 and 41 of body 11 laterally between the locations of tracks 91. As seen in FIGS. 4 and 8, each of these bushings may have an upper horizontal portion 107 slidably engaging an upper horizontal surface of the corresponding portion 102 or 103 of counterweight 28, and may have two downwardly protecting vertical parallel side portions 108 and 109 slidably engaging vertical parallel opposite side surfaces of the portion 102 or 103 of the counterweight. The upper portions of elements 104 are close fits within recesses 105 and 106, and are frictionally held by those recesses against movement relative to body 11. The horizontal undersurfaces 110 of counterweight 28 slidably engage and are supported by the horizontal upper surface 87 of shoe 22, while the upper horizontal surfaces 111 of portions 102 and 103 of the counterweight slidably engage the undersurfaces of top walls 107 of bushing elements 104, to effectively confine the counterweight against vertical movement, and coact with the side walls 108 and 109 of bushing elements 104 in permitting only the desired straight line reciprocating movement of counterweight 28 parallel to axis 14.

An intermediate reduced width portion 112 of counterweight 28 is received between the two lower gears 57 and 59 of units 27 and 26, and has two sets of rack teeth 113 and 114 at its opposite sides meshing with the teeth on gears 57 and 59 to cause straight line front to rear recirpocation of counterweight 28 corresponding to and in the same direction as the reciprocation of piston 13. The reciprocation of counterweight 28 is therefore in directions opposite to the reciprocation of shoe 22, and acts to counterbalance that shoe reciprocation. In this connection, it is noted that counterweight 22 is at a level closely adjacent and actually slidably supported by the shoe and therefore can counterbalance the shoe very effectively.

The two upper counterweights 29 and 30 are located well above the level of counterweight 28 and shoe 22, and more particularly are positioned at essentially the level of piston 13, and at opposite sides thereof. These counterweights 29 and 30 reciprocate in opposition to the piston, to counterbalance the reciprocation of the piston and thereby avoid any vibration of the tool body as a result of the piston movements. The two counterweights 29 and 30 reciprocate along two axes 115 and 116, which are parallel to one another and parallel to the axis 14 of reciprocation of the piston. Further, the two axes 115 and 116 are offset equidistantly from axis 14 in opposite horizontal directions and lie in a common horizontal plane with axis 14.

The two counterweights 29 and 30 are elongated longitudinally of their axes 115 and 116, and preferably have cross sections which are centered about those axes. At their inner sides, counterweights 29 and 30 have rack teeth 117 which mesh with gears 56 and 58 of gear units 27 and 26 respectively to effect the desired reciprocation of counterweights 29 and 30 in unison and in opposition to the reciprocation of the piston. The two counterweights 29 and 30 may be of essentially rectangular cross section transversely of their axes 115 and 116, and be received within recesses 118 of rectangular cross section formed in the opposite sides of main body section 39.

Two channel shaped bushing or guide elements 119 may be provided in recesses 118 and may be close fits within those recesses and about counterweight elements 29 and 30 to effectively guide the counterweights for only their desired sliding movement along axes 115 and 116. These bushings are formed of a suitable low friction preferably resinous plastic material resistant to wear, such as the product sold by E. I. DuPont de nemours under the trade designation Delrin 500 AF, which material is a mixture of an acetal thermoplastic ("Delrin") and polytetrafluoroethylene ("Teflon"). Each of the bushing elements 119 may be of U-shaped transverse section, having a vertical portion 120 slidably engaging an outer vertical surface 121 of the corresponding counterweight 29 or 30, and having two horizontal portions 122 and 123 slidably engaging upper and lower horizontal surfaces of the corresponding counterweight to confine it against vertical movement. A rectangular plate 124 secured rigidly to the main body-section 39 at the outer side of each of the recesses 118 retains the corresponding bushing element 119 in place and closes the outer side of the recess. These plates 114 may be secured in their illustrated positions in any convenient manner, as by screws 125 extending through plates 124 and connecting into the main central section 39 of the body.

The center of gravity CG of counterweight 29 is preferably located on the discussed horizontal axis 115 of counterweight 29, and the center of gravity C'G' of counterweight 30 is similarly preferably located on the corresponding axis 116 of that counterweight. Further, these two centers of gravity are desirably so located that the midpoint of their horizontal oscillatory movement is in a central vertical transverse plane 126 of the tool, which plane preferably contains the vertical axes 52 and 53 of gear units 26 and 27. The centers of gravity of the other reciprocating parts, that is, piston 13, shoe 22 and its carried pad 23, and lower counterweight 28, also preferably have the midpoints of their reciprocating movements located in the central transverse vertical plane 126. Thus, all of the reciprocating movements are balanced with respect to a common central plane 126. The centers of gravity of the two upper counterweights 29 and 30 are also preferably disposed within a horizontal plane 226 which contains axes 14, 115 and 116, and which contains the center of gravity of the piston.

The two bearing elements 31 and 32 are elongated in a direction essentially parallel to main axis 14 of the piston and tool, and extend along opposite side edges of body 11. As seen in FIGS. 2 and 8, each of these bearing elements has two relatively wide portions 31 and 32 at its opposite ends and an intermediate narrower portion 151. The elements 31 and 32 have upper horizontal planar surfaces 128 (FIG. 4) engaging horizontal planar undersurfaces 129 of body 11, and have horizontal planar bottom surfaces 130 slidably engaging the upper horizontal surface 87 of shoe 22 to transmit downward force thereto. Elements 31 and 32 are formed of a suitable low friction wear resistant preferably resinous plastic bearing material, such as the DuPont material Delrin AF previously discussed in this application. Elements 31 and 32 are retained against movement relative to body 11, as by provision of two upwardly projecting pins 131 and 231 formed on and preferably integral with each of the elements, with these pins extending upwardly into a mating recess in the bottom of section 39 of body 11. The undersurfaces 129 of the body against which top surfaces 128 of the bearing elements engage are formed partially on the central section 39 of body 11 and partially on its opposite end sections 40 and 41. Track elements 91 are so shaped and dimensioned as to retain shoe 22 upwardly against bearing elements 31 and 32, with these bearing elements being retained closely between and in simultaneous engagement with the shoe and body surfaces. As seen in FIGS. 2 and 8, one of the pins 131 of each bearing element 31 or 32, and the body recess within which it is received in confined locating relation, may be cylindrical about a vertical axis, while the second pin 231 of each bearing element, may be flattened to a thin vertical fin shape for reception and confinement within a similarly shaped body recess to assist in assuring against lateral movement of elements 31 and 32. The two bearing elements 31 and 32 may be identical to one another and interchangeable for simplicity of manufacture and installation.

Figure 9:
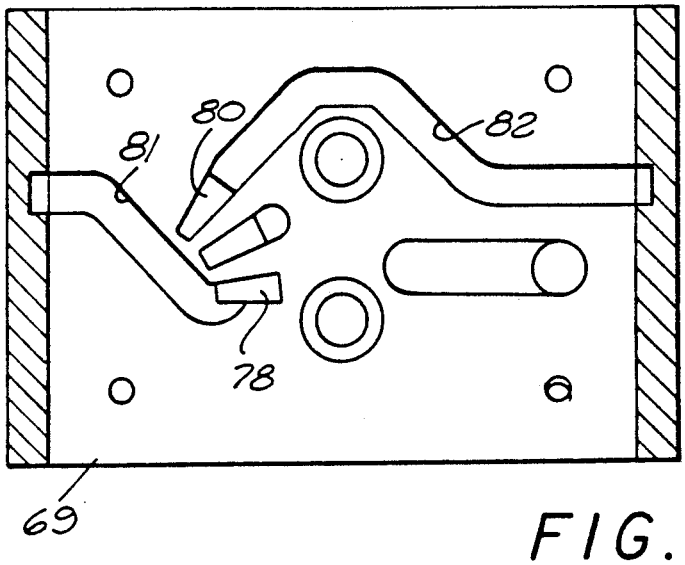
FIG. 9 is a horizontal section taken on line 9—9 of FIG. 3.

Pad 23 may include an upper horizontal flat essentially rigid backing plate 132 carrying a deformable cushion body 133 at its underside. The previously mentioned air flow passages 34 in the pad are formed in its lower deformable portion 133, and may be arranged in the pattern illustrated in. FIG. 9, including two main parallel horizontal passages 134 and a number of branch passages 135 leading to vertical passages 136 extending downwardly to the bottom surface of cushion 133. The sandpaper sheet 124 may contain openings 137 registering with passages or openings 136 in the pad, to allow flow of air and abraded particles upwardly through these aligned openings and through the pattern of passages to the location of two openings 137 formed in top plate 132 of the pad. These openings 137 are spaced laterally apart near opposite side edges of the pad, and communicate with two openings 138 formed in shoe plate 22. Openings 138 communicate with openings 38 formed in the two bushing elements 31 and 32, to deliver air and abraded particles thereto. As seen in FIGS. 2 and 8, the openings 38 in the bearing elements are formed in the rear wide portions 33 of elements 31 and 32, and are elongated parallel to axis 14, and of a length to remain in communication with the openings 138 in shoe 22 as the shoe and pad reciprocate relative to the body of the tool. Additional openings **38*a* may be formed in the forward portions of elements 31 and 32 but do not serve any function in use, and are merely to render the elements 31 and 32** completely identical in structure and interchangeable in position within the tool.

At the upper side of openings 38 in the two bearing elements 31 and 32, body 11 contains two passages 139 for conducting air and abraded particles upwardly toward aspirator 38. These passages 139 may at their lower ends be elongated horizontally to the same shape as openings 38 in bearing strips 31 and 32. As passages 139 extend upwardly, their horizontal cross section changes from the elongated shape of openings 38 to a circular shape at the upper ends of passages 139. The passages 139 may be formed primarily in the horizontally projecting flange portion 46 of rear end member 41 of the body, but may also be formed partially in the end of main section 39 of the body. Short vertical tubes 153 are pressed fits within upper portions of these passages 139, and project upwardly into openings 154 in a horizontal bottom wall 155 of a hollow upwardly tapering conduit element 156 whose inner chamber 157 communicates at its upper end with the aspirator. The aspirator thus draws air and particles upwardly by suction through passages 139, tubes 153 and passage 157 in element 156 for delivery by the aspirator to collection bag 36. Seal rings 158 about tubes 153 engage upwardly and downwardly against element 156 and part 40 to form a seal therebetween.

When the tool is in use, counterweight 28 reciprocates in opposition to the reciprocation of shoe 22 and pad 23, and is located closely adjacent the shoe to effectively counterbalance its movements. The upper counterweights 29 and 30 are located at the same level as piston 13, and at opposite sides of the piston, and are reciprocated in opposition to the reciprocatory movement of the piston, to effectively counterbalance its movements. Preferably, the weight of counterweight 28 is exactly equal to the combined weight of shoe 22 and all of the parts reciprocating therewith, including pad 23, racks 96 and 97 and sandpaper 24, to exactly counterbalance the entire shoe assembly. Also, the combined weight of the two upper counterweights 29 and 30 is preferably equal to the total weight of piston 13, including its heads 47 and 48, intermediate portion 49, and any rings 159 which may be provided on the piston heads. The result is optimum balancing of all of the reciprocating movements, and minimization of any vibratory effect on the body 11 of the tool or the user's hands by which that body is held and manipulated.

The provision of openings 38 in bearing elements 31 and 32 allows effective withdrawal of the flow of air and abraded particles from the work surface without the necessity for additional sealing parts.

While a certain specific embodiment of the present invention has been disclosed as typical, the invention is of course not limited to this particular form, but rather is applicable broadly to all such variations as fall within the scope of the appended claims.

I claim:

1. A portable abrading tool comprising:

a body to be held and manipulated by a user and carrying a motor;

a shoe which, in a predetermined position of the tool, is located beneath the body and is reciprocated relative to said body by said motor to abrade or polish an upwardly facing work surface, and which is adapted to carry a pad carrying an abrading element;

said pad containing passage means through which air and abraded particles are withdrawn by suction from near the work surface; and at least one bearing element interposed vertically between said body and said shoe and having upper and lower surfaces engaging a downwardly facing surface of said body and an upwardly facing surface of said shoe respectively to transmit force downwardly from the body through said bearing element to the shoe while permitting reciprocation of the shoe relative to the body;

said bearing element containing an opening extending generally vertically therethrough between said upper and lower surfaces of the bearing element and which communicates upwardly at said upper surface with an opening in said downwardly facing surface of the body, and communicates downwardly at said lower surface of the bearing element with an opening in said upwardly facing surface of the shoe leading to said passage means, to conduct air and particles from said passage means through said opening in the bearing element and through said body to a collection location.

2. A portable abrading tool as recited in claim 1, in which said lower surface of the bearing element is slidably engaged by said upwardly facing surface of said shoe to apply force thereto while permitting reciprocation of the shoe relative to the bearing element; said opening in said bearing element and said opening in said upwardly facing surface of the shoe being dimensioned to remain in communication as the shoe reciprocates relative to the body.

3. A portable abrading tool as recited in claim 1, in which there are two of said bearing elements interposed between said body and said shoe near opposite side edges thereof, with each of said bearing elements containing an opening as defined in claim 32 communicating with said passage means in the pad and with a downwardly facing opening in the body for conducting air and particles from said passage means through the bearing elements and body to a collection location.

4. A portable abrading tool comprising:

a body to be held and manipulated by a user and containing a cylinder chamber;

a piston structure which is reciprocated within said cylinder chamber by pressure fluid;

a shoe which in a predetermined position of the tool is located beneath said piston structure, and which is reciprocated generally horizontally relative to the body by said piston structure but oppositely from the piston structure to abrade or polish an upwardly facing work surface beneath the shoe;

gear units at opposite sides of said piston structure having upper teeth which engage rack teeth on said piston structure and having lower teeth which engage rack teeth carried by said shoe to reciprocate the shoe oppositely from the piston structure;

a pad carried by and reciprocable with said shoe and adapted to carry a sheet for abrading a work surface;

said pad containing passages through which air and abraded particles are withdrawn by suction from near the work surface;

two bearing elements interposed vertically between said body and said shoe along opposite side edges of the body and having upper and lower surfaces engaging downwardly facing surfaces of said body and upwardly facing surfaces of said shoe respectively to transmit force downwardly from the body through said bearing elements to the shoe while permitting reciprocation of the shoe relative to the body;

at least one of said bearing elements containing an opening extending generally vertically therethrough between said upper and lower surfaces thereof and which communicates upwardly at said upper surface with an opening in one of said downwardly facing surfaces of the body, and communicates downwardly at said lower surface of the bearing element with an opening in one of said upwardly facing surfaces of the shoe leading to said passages, to conduct air and particles from said passages through said opening in the bearing element and through the body to a collection location.

5. A portable abrading tool as recited in claim 4, in which said two bearing elements contain two openings respectively communicating upwardly with two openings in said downwardly facing surfaces of the body, and communicating downwardly with two openings in said upwardly facing surfaces of the shoe, to conduct air and particles from said passages through both of said bearing elements and through the body to a collection location.

6. A portable abrading tool as recited in claim 4, including means retaining said bearing elements against movement relative to said body, said bearing elements engaging said shoe slidably, said opening in said one bearing element being elongated in the direction of reciprocation of the shoe relative to said body.

7. A portable abrading tool as recited in claim 4, in which said bearing elements are retained against movement relative to the body and slidably engage said shoe, and contain two of said openings respectively elongated in the direction of reciprocation of said shoe and communicating with two of said openings in the shoe to deliver air and particles from the passages in the shoe through said elongated openings in both of said bearing elements and through said body to a collection location.

* * * * *